US010089910B2

(12) United States Patent
Sugiyama et al.

(10) Patent No.: US 10,089,910 B2
(45) Date of Patent: Oct. 2, 2018

(54) IMAGE DISPLAY DEVICE, CORRECTION DATA GENERATION METHOD, AND IMAGE CORRECTION DEVICE AND METHOD, AS WELL AS IMAGE CORRECTION SYSTEM

(71) Applicant: MegaChips Corporation, Osaka (JP)

(72) Inventors: Hitoshi Sugiyama, Chiba (JP); Hideo Nakano, Chiba (JP); Junichi Komine, Chiba (JP)

(73) Assignee: MegaChips Corporation, Osaka (JP)

( * ) Notice: Subject to any disclaimer, the term of this patent is extended or adjusted under 35 U.S.C. 154(b) by 70 days.

(21) Appl. No.: 14/964,147

(22) Filed: Dec. 9, 2015

(65) Prior Publication Data

US 2016/0163252 A1 Jun. 9, 2016

(30) Foreign Application Priority Data

Dec. 9, 2014 (JP) ..... 2014-249238

(51) Int. Cl.
*G09G 3/20* (2006.01)
*G09G 3/00* (2006.01)

(52) U.S. Cl.
CPC ..... *G09G 3/006* (2013.01); *G09G 2320/0233* (2013.01); *G09G 2320/0242* (2013.01);
(Continued)

(58) Field of Classification Search
CPC ..... G09G 3/2007; G09G 3/36; G09G 2320/0233; G09G 2320/0271; G09G 2320/029; G09G 3/006; G09G 2320/0693; G09G 2320/0242; G03F 7/70083; G03F 7/70233; G03F 7/70358; G03F 7/70075; G03F 7/203; G03F 7/70466;
(Continued)

(56) References Cited

U.S. PATENT DOCUMENTS

2004/0257454 A1* 12/2004 Pinto ..... G06T 5/006 348/222.1
2010/0157047 A1* 6/2010 Larkin ..... H04N 9/3191 348/135
(Continued)

FOREIGN PATENT DOCUMENTS

JP 2007-279417 A 10/2007
JP 2010-057149 A 3/2010
(Continued)

*Primary Examiner* — Xilin Guo
(74) *Attorney, Agent, or Firm* — Osha Liang LLP

(57) ABSTRACT

In the image display device, the vignetting pattern generator generates a vignetting pattern image composed of image data having inverted brightness characteristics obtained by inverting brightness characteristics of a panel of the liquid crystal display. The display controller carries out control to cause a pattern image obtained by combining a flat pattern image in gray composed of image data having a uniform grayscale level and the vignetting pattern image to be displayed on the liquid crystal display. And the correction data calculator calculates correction data for correcting brightness unevenness of an input image based on brightness values of image data of captured images obtained by imaging, by the camera, the pattern images displayed on the liquid crystal display.

14 Claims, 10 Drawing Sheets

(52) U.S. Cl.
CPC ..... *G09G 2320/0271* (2013.01); *G09G 2320/0295* (2013.01); *G09G 2320/0693* (2013.01)

(58) Field of Classification Search
CPC ..... G03F 7/70191; G03F 7/70133; G03F 7/70108; G03F 7/702; H04N 5/2256; H04N 5/23238; H04N 1/6027; H04N 1/387; H04N 5/2254; H04N 5/247; H04N 5/23212; H04N 5/23229; H04N 9/735; G06T 5/50; G06T 5/009; G06T 2207/20021; G06T 7/80; G06T 2207/20076; G06T 2207/10024; G06T 5/003; G06T 15/506; G02B 21/0076; G02B 21/008; G02B 21/365; G02B 27/0025; G02B 21/0088; G02B 21/0052; G02B 21/02
See application file for complete search history.

(56) References Cited

U.S. PATENT DOCUMENTS

| | | | | |
|---|---|---|---|---|
| 2011/0116694 | A1* | 5/2011 | Gareau ..... | G01N 21/6458 382/128 |
| 2011/0285758 | A1* | 11/2011 | Matsushita ..... | G09G 3/3426 345/690 |
| 2012/0218570 | A1* | 8/2012 | Tanaka ..... | H04N 1/40012 358/1.9 |

FOREIGN PATENT DOCUMENTS

| | | | |
|---|---|---|---|
| JP | 2011-242665 | A | 12/2011 |
| JP | 2012-085225 | A | 4/2012 |
| WO | 2010/013753 | A1 | 2/2010 |

* cited by examiner

IMAGE DISPLAY DEVICE, CORRECTION DATA GENERATION METHOD, AND IMAGE CORRECTION DEVICE AND METHOD, AS WELL AS IMAGE CORRECTION SYSTEM

CROSS-REFERENCE TO RELATED APPLICATIONS

The present application claims priority under 35 U.S.C. § 119 to Japanese Patent Application No. 2014-249238, filed on Dec. 9, 2014. The above application is hereby expressly incorporated by reference, in its entirety, into the present application.

BACKGROUND OF THE INVENTION

The present invention relates to an image display device that causes an image used for generating correction data for correcting brightness unevenness of an input image inputted to a liquid crystal display to be displayed on the liquid crystal display, a correction data generation method for generating the correction data, and an image correction device and method for correcting brightness unevenness of an input image with the correction data, as well as an image correction system.

Occasionally, liquid crystal displays do not exhibit uniform brightness and brightness unevenness may occur. Occurrence of brightness unevenness means significant degradation in display quality and to deal with it, a method of achieving the display with uniform brightness by electrically correcting brightness unevenness is commonly known.

For instance, JP 2010-57149 A describes an image correction circuit and the like that correct brightness unevenness of an input image by causing a gray image composed of image data having a uniform grayscale level and corresponding to one screen to be displayed on a liquid crystal display, imaging the gray image with a camera, generating correction data for mitigating brightness unevenness based on brightness values of the image captured by the camera, storing the correction data in a read-only memory (ROM) in the liquid crystal display, and correcting the brightness unevenness of the input image using the correction data stored in the ROM to display the input image on the liquid crystal display.

Prior art literatures related to the present invention other than JP 2010-57149 A include JP 2012-85225 A describing an image quality adjustment system and an image quality adjustment method, JP 2007-279417 A describing an image correction system and JP 2011-242665 A describing an image display device.

SUMMARY OF THE INVENTION

The case is examined where, for example, the image correction circuit and the like described in JP 2010-57149 A are used for a liquid crystal display having brightness characteristics in which the brightness value is low in the middle of a panel and gradually increases as approaching either of the right and left edges from the middle of the panel, and an image composed of image data having a uniform grayscale level of 25 (25 in a range from 0 to 255 in 8-bit grayscale) and corresponding to one screen is displayed on the liquid crystal display.

In this case, when a detection value in the middle of the panel of the liquid crystal display as obtained using the camera is 152, detection values before correction at the right and left edges are respectively 190 and 244 and target values after correction at the right and left edges to be used for mitigating brightness unevenness of the gray image displayed on the liquid crystal display are respectively 122 and 134, the amounts of correction are to be respectively 68 and 110 and are thus very large.

As is evident from the above, particularly when correction data is generated using a dark gray image composed of image data at a grayscale level of 25 or such levels, the amounts of correction for mitigating brightness unevenness are to be large. When the amounts of correction are large, imaging the image one time is not enough to attain sufficient correction accuracy and the image needs to be repeatedly imaged two or three times to finish the generation of correction data. However, repetitive imaging of the image leads to increased takt time and lower production efficiency.

The present invention aims at solving the foregoing problem of the prior art and providing an image display device, a correction data generation method and an image correction device and method as well as an image correction system capable of generating correction data to correct brightness unevenness of an image in a shorter time than that in the conventional art.

In order to attain the object described above, the present invention provides an image display device for causing an image used for generating correction data for correcting brightness unevenness of an input image inputted to a liquid crystal display to be displayed on the liquid crystal display, comprising:

a vignetting pattern generator which generates a vignetting pattern image composed of image data having inverted brightness characteristics obtained by inverting brightness characteristics of a panel of the liquid crystal display; and a display controller which carries out control to cause a pattern image obtained by combining a flat pattern image in gray composed of image data having a uniform grayscale level and the vignetting pattern image to be displayed on the liquid crystal display.

Also, the present invention provides an image correction device for correcting brightness unevenness of an input image inputted to a liquid crystal display, comprising:

the image display device according to above;

a correction data storage which stores correction data calculated by a correction data, calculator based on brightness values of image data of a captured image obtained by imaging the pattern image displayed on the liquid crystal display with a camera; and an image corrector which corrects the brightness unevenness of the input image using the correction data stored in the correction data storage.

Also, the present invention provides an image correction system for generating correction data for correcting brightness unevenness of an input image inputted to a liquid crystal display, and correcting the brightness unevenness of the input image using the correction data, comprising:

the image correction device according to above;

a camera which images the pattern image displayed on the liquid crystal display to generate image data of a captured image;

a correction data calculator which calculates correction data for correcting the brightness unevenness of the input image based on brightness values of the image data of the captured image as generated by the camera; and a control device which controls an operation of the image correction device when the correction data is generated.

Also, the present invention provides a correction data generation method for generating correction data for correcting brightness unevenness of an input image inputted to a liquid crystal display, comprising:

a step of generating, with a flat pattern generator, a flat pattern image in gray composed of image data having a uniform grayscale level;

a step of generating, with a vignetting pattern generator, a vignetting pattern image composed of image data having inverted brightness characteristics obtained by inverting brightness characteristics of a panel of the liquid crystal display;

a step of carrying out, with a display controller, control to cause a pattern image obtained by combining the flat pattern image and the vignetting pattern image to be displayed on the liquid crystal display;

a step of imaging, with a camera, the pattern image displayed on the liquid crystal display to generate image data of a captured image; and a step of calculating, with a correction data calculator, the correction data for correcting the brightness unevenness of the input image based on brightness values of the image data of the captured image as generated by the camera.

Also, the present invention provides an image correction method for correcting brightness unevenness of an input image inputted to a liquid crystal display, comprising:

a step of generating, with a flat pattern generator, a flat pattern image in gray composed of image data having a uniform grayscale level;

a step of generating, with a vignetting pattern generator, a vignetting pattern image composed of image data having inverted brightness characteristics obtained by inverting brightness characteristics of a panel of the liquid crystal display;

a step of carrying out, with a display controller, control to cause a pattern image obtained by combining the flat pattern image and the vignetting pattern image to be displayed on the liquid crystal display;

a step of imaging, with a camera, the pattern image displayed on the liquid crystal display to generate image data of a captured image;

a step of calculating, with a correction data calculator, correction data for correcting the brightness unevenness of the input image based on brightness values of the image data of the captured image as generated by the camera;

a step of storing, with a correction data storage, the correction data calculated by the correction data calculator; and a step of correcting, with an image corrector, the brightness unevenness of the input image using the correction data stored in the correction data storage.

In the present invention, the pattern image obtained by combining the flat pattern image and the vignetting pattern image is used to calculate the correction data. With this configuration, according to the present invention, the amount of correction in correcting brightness unevenness of an input image is decreased and therefore, imaging the image one time is enough to attain sufficient correction accuracy, so that the generation of the correction data can be finished earlier than the cases of conventional examples. This results in a shorter takt time and improved production efficiency.

DETAILED DESCRIPTION OF THE INVENTION

On the following pages, an image display device, correction data generation method and an image correction device and method as well as an image correction system of the invention are described in detail with reference to preferred embodiments shown in the accompanying drawings.

Figure 1:
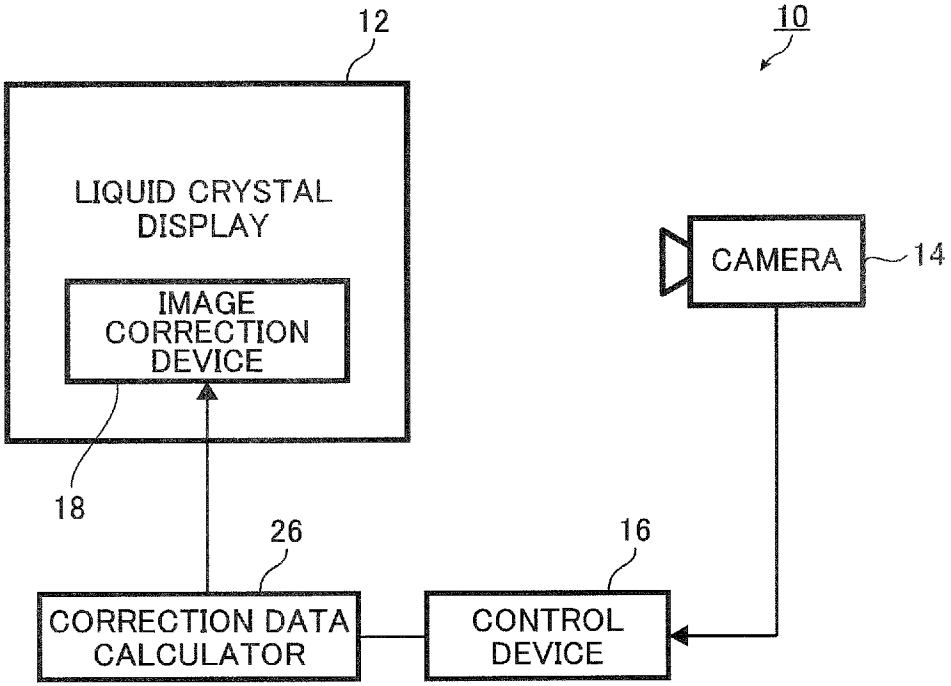
FIG. 1 is a conceptual diagram of an embodiment for showing the configuration of an image correction system of the invention.

FIG. 1 is a conceptual diagram of an embodiment for showing the configuration of an image correction system of the invention. An image correction system 10 shown in FIG. 1 serves to generate correction data for correcting brightness unevenness of an input image inputted to a liquid crystal display 12 and correct the brightness unevenness of the input image using the generated correction data, and is constituted of a camera 14, a control device 16, a correction data calculator 26 and an image correction device 18.

The camera 14 images a pattern image displayed on the liquid crystal display 12 to generate image data of the captured image.

The camera 14 may be used to manually image a pattern image or to image a pattern image according to an imaging instruction inputted from the control device 16.

The control device 16 is constituted of, for instance, a personal computer or the like and controls the operation of the image correction device 18 when correction data is generated before the liquid crystal display 12 is shipped as a product.

When correction data is generated, the control device 16 acquires the image data of a captured image as generated by the camera 14 and inputs the image data to the image correction device 18 and in addition, provides the image correction device 18 and the correction data calculator 26 with various instructions including an instruction of designating a grayscale level of image data of a gray flat pattern image and an instruction of causing a pattern image to be displayed on the liquid crystal display 12.

The correction data calculator 26 calculates correction data for correcting brightness unevenness of an input image based on brightness values of image data of an image captured by the camera 14 as inputted from the control device 16.

The correction data calculator 26 is capable of calculating correction data for use in correction from brightness values of image data of a captured image so that when a gray flat pattern image composed of image data having a uniform grayscale level and corresponding to one screen is displayed on the liquid crystal display 12, the image displayed on the liquid crystal display 12 exhibits a uniform brightness.

The correction data calculator 26 may also be constituted of, for instance, software executed by the control device 16.

Figure 2:
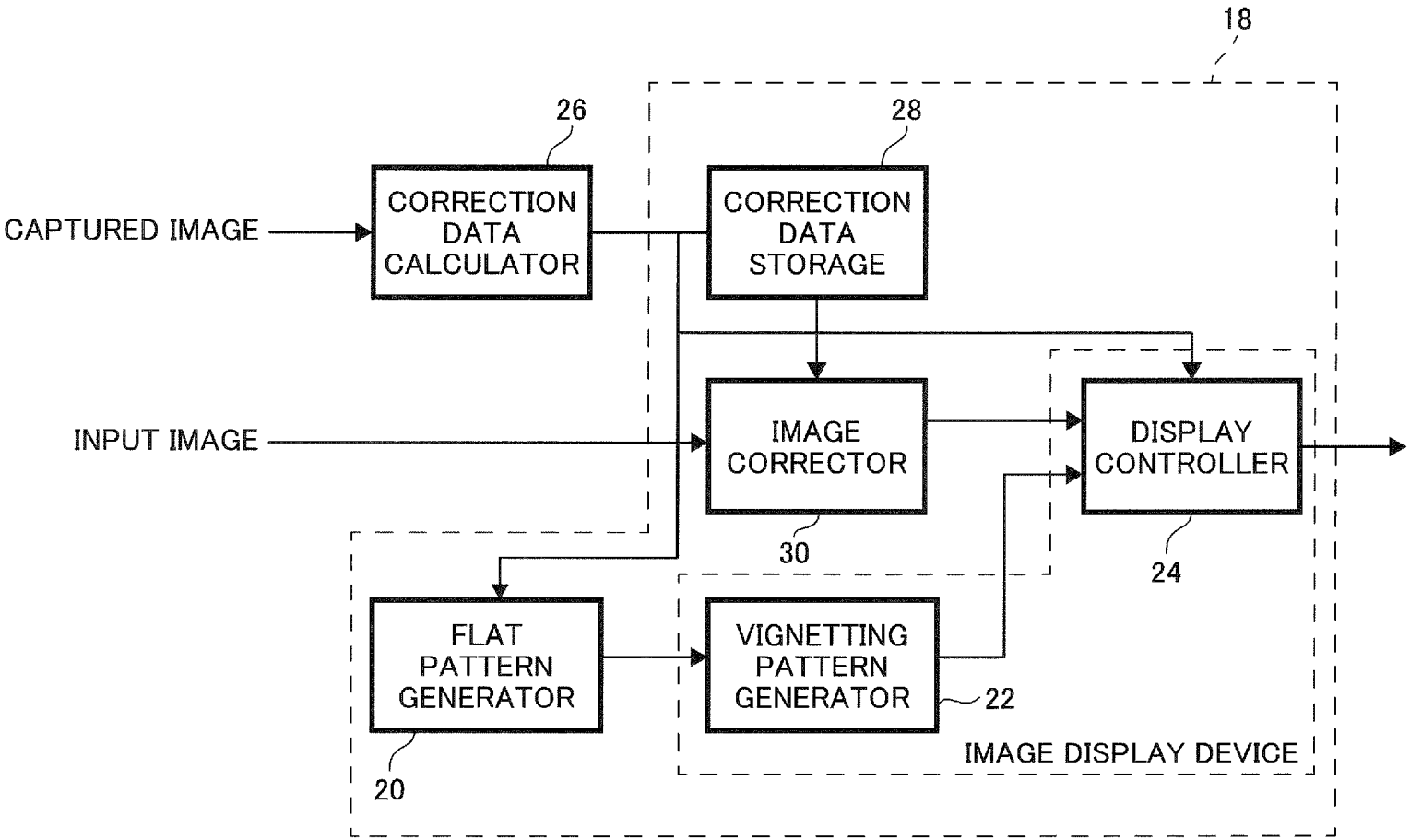
FIG. 2 is a block diagram showing an example of the configuration of an image correction device shown in FIG. 1.

The image correction device 18 is disposed in the liquid crystal display 12 as a built-in device and as shown in FIG. 2, includes a flat pattern generator 20, a vignetting pattern generator 22, a display controller 24, a correction data storage 28 and an image corrector 30.

The vignetting pattern generator 22 and the display controller 24 constitute the image display device of the invention that causes an image (pattern image) for use in generating correction data to be displayed on the liquid crystal display 12.

The configuration in which the liquid crystal display 12 has the vignetting pattern generator 22 as a built-in element is not indispensable. For instance, the vignetting pattern generator 22 may be constituted of software executed by the control device 16 and in this case, image data of a vignetting pattern image is inputted from the control device 16 to the image correction device 18.

The flat pattern generator 20 generates a gray flat pattern image composed of image data having a uniform grayscale level in accordance with an instruction sent from the control device 16.

The vignetting pattern generator 22 generates a vignetting pattern image composed of image data having inverted brightness characteristics obtained by inverting brightness characteristics of a panel of the liquid crystal display 12.

In the image data of the vignetting pattern image, image data in the middle of the liquid crystal display 12 and image data at a peripheral portion of the same differ in accordance with the inverted brightness characteristics derived from the brightness characteristics of the panel of the liquid crystal display 12.

The pattern image is obtained by combining the flat pattern image and the vignetting pattern image.

Figure 3A:
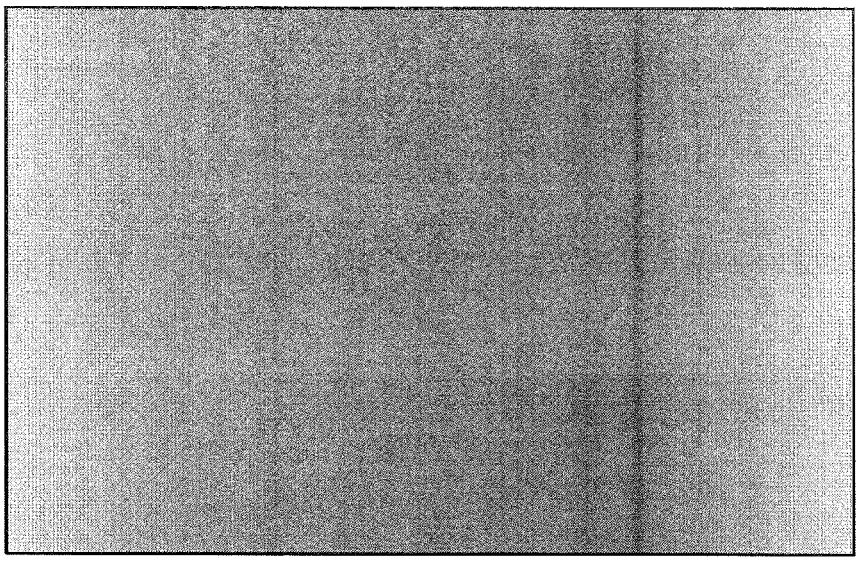
FIG. 3A is a conceptual diagram showing an example of an image displayed on a liquid crystal display.
Figure 3B:
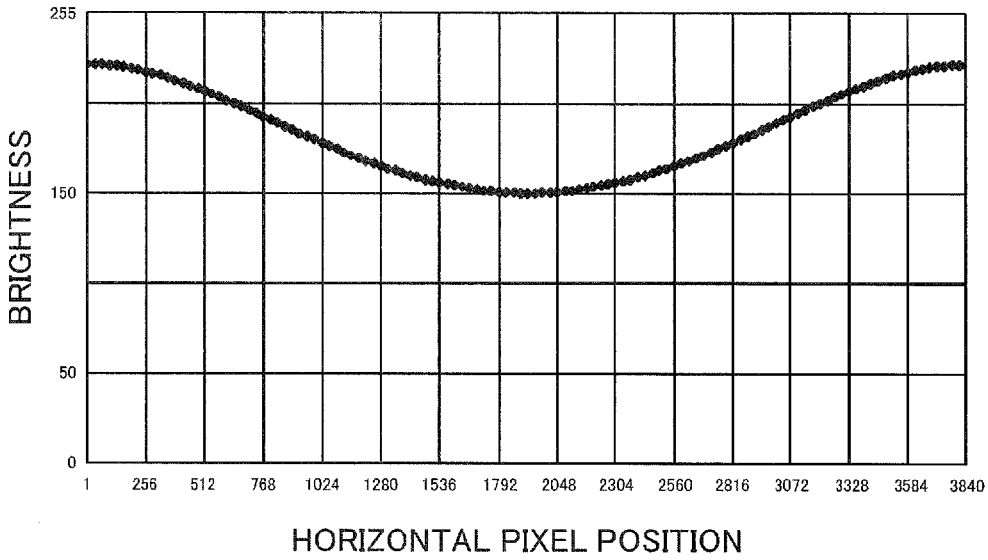
FIG. 3B is a graph showing an example of brightness characteristics of the liquid crystal display shown in FIG. 3A.

FIG. 3A is a conceptual diagram showing an example of an image displayed on the liquid crystal display; and FIG. 3B is a graph showing an example of brightness characteristics of the liquid crystal display shown in FIG. 3A. FIG. 3A shows a display screen when a gray flat pattern image composed of image data having a uniform grayscale level of 25 is displayed on the liquid crystal display 12. FIG. 3B shows brightness values of the display screen shown in FIG. 3A at respective pixel positions from 1 to 3840 in the horizontal direction.

The flat pattern image displayed on the liquid crystal display 12 is the darkest in the middle portion of the panel and the brightness gradually increases as approaching either of the right and left edges from the middle as shown in FIG. 3A. In other words, the liquid crystal display 12 has the brightness characteristics in which the brightness value is the lowest in the middle of the panel and gradually increases as approaching either of the right and left edges from the middle as shown in FIG. 3B.

Figure 4:
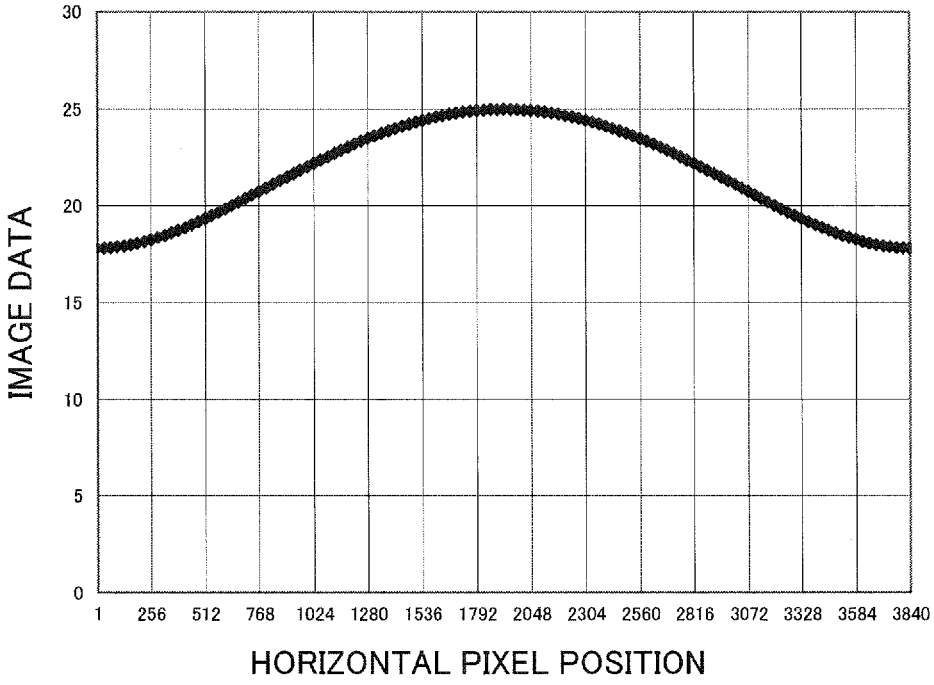
FIG. 4 is a graph showing an example of image data of vignetting pattern.

FIG. 4 is a graph showing an example of image data of vignetting pattern. FIG. 4 shows image data of a pattern image in the horizontal direction as obtained by combining the gray flat pattern image composed of the image data having a uniform grayscale level of 25 and the vignetting pattern image composed of the image data having the inverted brightness characteristics obtained by inverting the brightness characteristics of the liquid crystal display 12 shown in FIGS. 3A and 3B.

In the case of the liquid crystal display 12 having the brightness characteristics shown in FIG. 3B, as shown in the graph of FIG. 4, the vignetting pattern image has the inverted brightness characteristics obtained by vertically inverting the brightness characteristics shown in FIG. 3B with the grayscale level of 25 of the flat pattern image being taken as the axis of inversion.

Note that the foregoing example is not the sole case and among liquid crystal displays 12, there is a liquid crystal display having the brightness characteristics in which the brightness value is the highest in the middle of a panel and gradually decreases as approaching a peripheral portion, that is, either of the right and left edges or the upper and lower edges from the middle.

The brightness characteristics of the liquid crystal display 12 differ depending on the driving method, the model, the panel size and the like thereof. For example, when the driving method of the liquid crystal display 12 is a vertical alignment (VA) method, the brightness unevenness tends to occur in such a manner that the peripheral portions are brighter than the middle, whereas when it is a twisted nematic (TN) method, the brightness unevenness may occur in such a manner that the peripheral portions are darker than the middle.

Even among liquid crystal displays 12 with the same driving method, the same model and the same panel size, the brightness characteristics may vary due to, for example, different production plants (different manufacturing facilities). Therefore, it is preferable to change the inverted brightness characteristics of the vignetting pattern image depending on at least one of factors influencing the brightness characteristics of the liquid crystal display 12, such as the driving method, the model, the panel size and the production plant.

The vignetting pattern image may be configured so that image data corresponding to pixels of the panel of the liquid crystal display 12 is set on a pixel-by-pixel basis or set at intervals of a certain number of pixels, e.g., 32 pixels, and image data is calculated by interpolation between the set pieces of image data.

When the brightness unevenness is present between the middle and each of the right and left edges in the liquid crystal display 12, the vignetting pattern image may be composed of image data for pixels of one row in the panel of the liquid crystal display 12. In this case, the image data of the vignetting pattern image for the one row is copied and used for each of other rows in the panel of the liquid crystal display 12. Thus, the same image data is applied in the vertical direction in the panel of the liquid crystal display 12.

On the other hand, when the brightness unevenness is present between the middle and each of the upper and lower edges in the liquid crystal display 12, the vignetting pattern image may be composed of image data for pixels of one column in the panel of the liquid crystal display 12. In this case, the image data of the vignetting pattern image for the one column is copied and used for all other columns in the panel of the liquid crystal display 12. Thus, the same image data is applied in the horizontal direction in the panel of the liquid crystal display 12.

When image data for one row or column is used, the image data of the vignetting pattern image may be calculated by an approximate expression that approximates a function represented by the graph of the inverted brightness characteristics of the vignetting pattern, e.g., an approximate expression obtained by combining a quadratic and a quartic.

For instance, in the case of a liquid crystal display 12 having a panel of 3840 pixels (horizontal)×2160 pixels (vertical), when the address of a pixel in the horizontal direction of the panel is defined as H_pixel_add, the value is to range from 1 to 3840. When, in addition, image data of the pixel in the middle is defined as C_Signal, a coefficient of a quadratic as X2 and a coefficient of a quartic as X4, image data of a vignetting pattern image at each pixel position in the horizontal direction can be calculated by the expression of: X2*((H_pixel_add-1920)/1920)^2+X4*((H_pixel_add-1920)/1920)^4+C_Signal, for example.

The display controller 24 carries out the control to cause the pattern image obtained by combining the flat pattern image and the vignetting pattern image to be displayed on the liquid crystal display 12 when the correction data is generated in accordance with an instruction sent from the control device 16.

Furthermore, when the input image is corrected, the display controller 24 carries out the control to cause the input image whose brightness unevenness has been corrected using the correction data to be displayed on the liquid crystal display 12.

The correction data storage 28 stores the correction data calculated by the correction data calculator 26.

The image corrector 30 corrects the brightness unevenness of the input image using the correction data stored in the correction data storage 28.

Figure 5:
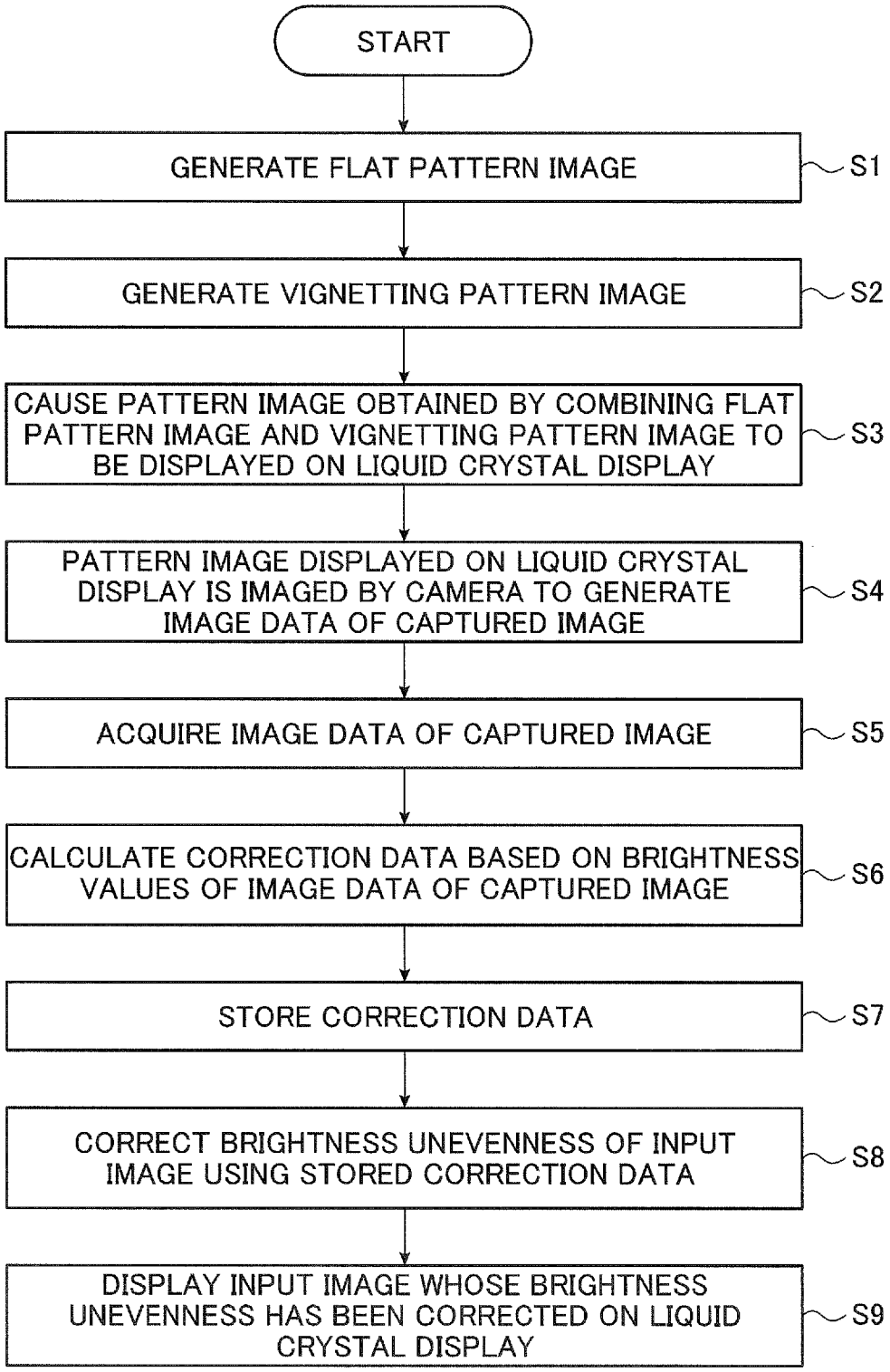
FIG. 5 is a flowchart showing an example of the operation of the image correction system shown in FIG. 1.

Next, the operation of the image correction system 10 will be described referring to the flowchart of FIG. 5.

First, in order to generate correction data, an instruction of designating a grayscale level of image data of a gray flat pattern image is sent from the control device 16 to the image correction device 18.

In response to the above, the flat pattern generator 20 generates a gray flat pattern image composed of image data having a uniform grayscale level in accordance with the instruction sent from the control device 16 (Step S1).

In addition, the vignetting pattern generator 22 generates a vignetting pattern image composed of image data having inverted brightness characteristics obtained by inverting brightness characteristics of the liquid crystal display 12 (Step S2).

Subsequently, an instruction of causing a pattern image to be displayed on the liquid crystal display 12 is sent from the control device 16 to the image correction device 18.

In response, a pattern image obtained by combining the flat pattern image and the vignetting pattern image is caused to be displayed on the liquid crystal display 12 through control by the display controller 24 (Step S3).

Subsequently, the pattern image displayed on the liquid crystal display 12 is imaged by the camera 14 to generate image data of the image captured by the camera 14 (Step S4). The image data of the captured image is acquired by the control device 16 (Step S5).

Subsequently, the image data of the captured image is inputted from the control device 16 to the correction data calculator 26.

In response, the correction data calculator 26 calculates correction data based on brightness values of the image data of the captured image (Step S6). The correction data calculated by the correction data calculator 26 is stored in the correction data storage 28 (Step S7).

Upon storage of the correction data in the correction data storage 28, the liquid crystal display 12 is separated from the correction data calculator 26 and the control device 16 and becomes ready for shipping as a product.

Subsequently, when an input image is to be displayed on the liquid crystal display 12, the image corrector 30 corrects brightness unevenness of the input image using the correction data stored in the correction data storage 28 (Step S8).

Then the input image whose brightness unevenness has been corrected by the image corrector 30 is displayed on the liquid crystal display 12 (Step S9).

In the liquid crystal display 12, the shape of brightness unevenness varies depending on the brightness (a value of image data of an input image) and therefore, the correction data may be calculated and used for every certain range of grayscale levels of image data of an input image.

In this case, the vignetting pattern generator 22 generates vignetting pattern images corresponding to respective certain ranges of grayscale levels of the image data of the input image.

Subsequently, the display controller 24 causes pattern images corresponding to the respective certain ranges of grayscale levels to be sequentially displayed on the liquid crystal display 12.

Subsequently, pattern images corresponding to the respective certain ranges of grayscale levels as displayed on the liquid crystal display 12 are sequentially imaged by the camera 14 to generate pieces of image data of the captured images. The pieces of image data of the captured images corresponding to the respective certain ranges of grayscale levels are acquired by the control device 16.

Subsequently, the correction data calculator 26 calculates pieces of correction data corresponding to the respective certain ranges of grayscale levels based on brightness values of the pieces of image data of the captured images corresponding to the respective certain ranges of grayscale levels. The pieces of correction data corresponding to the respective certain ranges of grayscale levels are stored in the correction data storage 28.

When an input image is displayed on the liquid crystal display 12, the image corrector 30 corrects brightness unevenness of the input image using the pieces of correction data corresponding to the grayscale levels of the image data of the input image and stored in the correction data storage 28.

Next, configuration examples of the image correction device 18 will be described.

FIGS. 6 to 10 are block diagrams showing first to fifth configuration examples of the image correction device. In each of image correction devices 18A, 18B, 18C, 18D and 18E in those figures, there are provided a gamma correction circuit 34 and a frame rate control circuit 36 which are included in the liquid crystal display 12.

Figure 6:
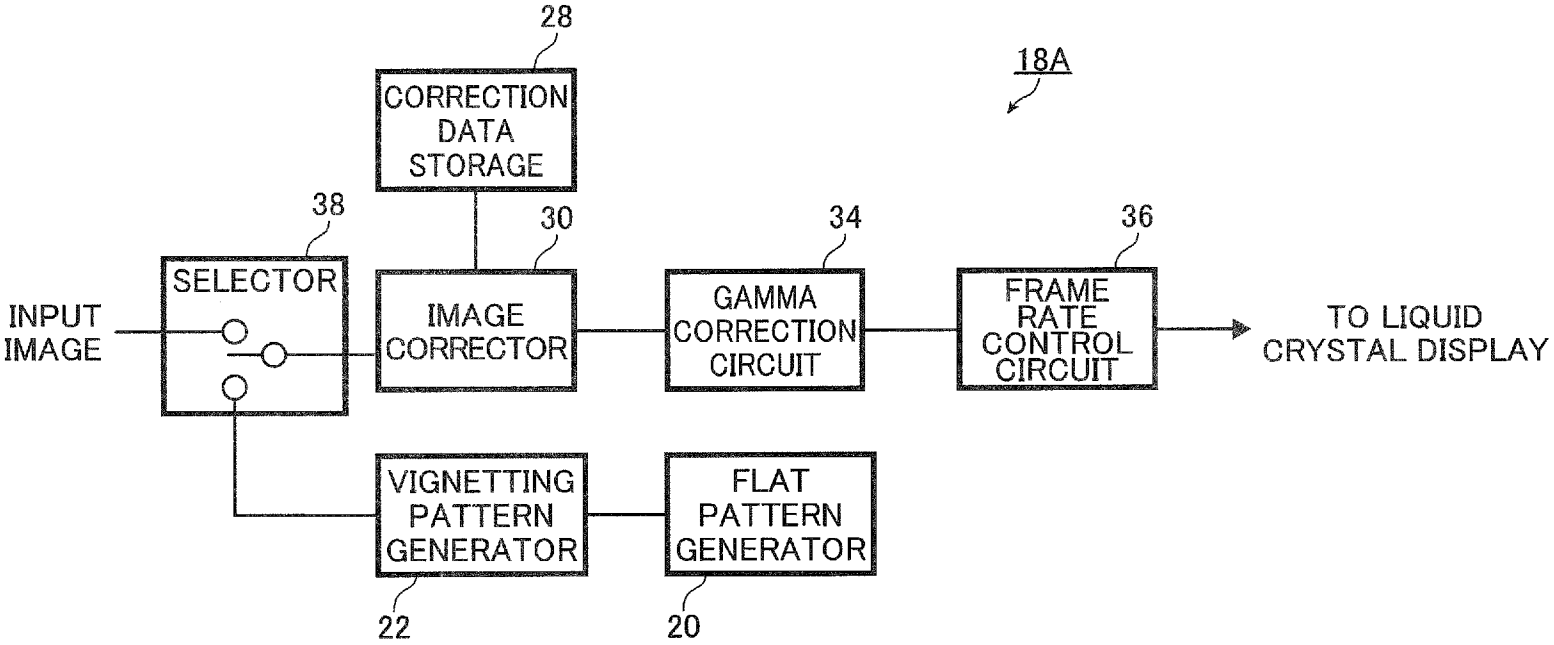
FIG. 6 is a block diagram showing a first configuration example of the image correction device.

In the image correction device 18A shown in FIG. 6, in the case where a pattern image is displayed on the liquid crystal display 12, correction data with which brightness unevenness is not corrected is stored in the correction data storage 28. In other words, in the initial state before correction data is generated, correction data for correcting brightness unevenness of an input image is not stored in the correction data storage 28 but the correction data with which brightness unevenness is not corrected is stored therein.

In the image correction device 18A, a pattern image obtained by combining a flat pattern image and a vignetting pattern image is inputted to the image corrector 30 through control by a selector 38.

Accordingly, in the image corrector 30, the brightness unevenness of the pattern image is not corrected with the correction data with which brightness unevenness is not corrected as stored in the correction data storage 28. That is, the pattern image is outputted from the image corrector 30 without any modification.

The pattern image outputted from the image corrector 30 is subjected to image processing such as gamma correction by the gamma correction circuit 34, thereafter to frame rate control by the frame rate control circuit 36, and then displayed on the liquid crystal display 12.

On the other hand, in the case where an input image is displayed on the liquid crystal display 12, correction data for correcting brightness unevenness of an input image is stored in the correction data storage 28.

In the image correction device 18A, an input image is inputted to the image corrector 30 through control by the selector 38.

Subsequently, the image corrector 30 corrects brightness unevenness of the input image using the correction data for correcting brightness unevenness of an input image as stored in the correction data storage 28, whereafter the input image is displayed on the liquid crystal display 12 in the same manner as above.

The control to cause the pattern image and the input image to be displayed on the liquid crystal display 12 is performed by the display controller 24.

Figure 7:
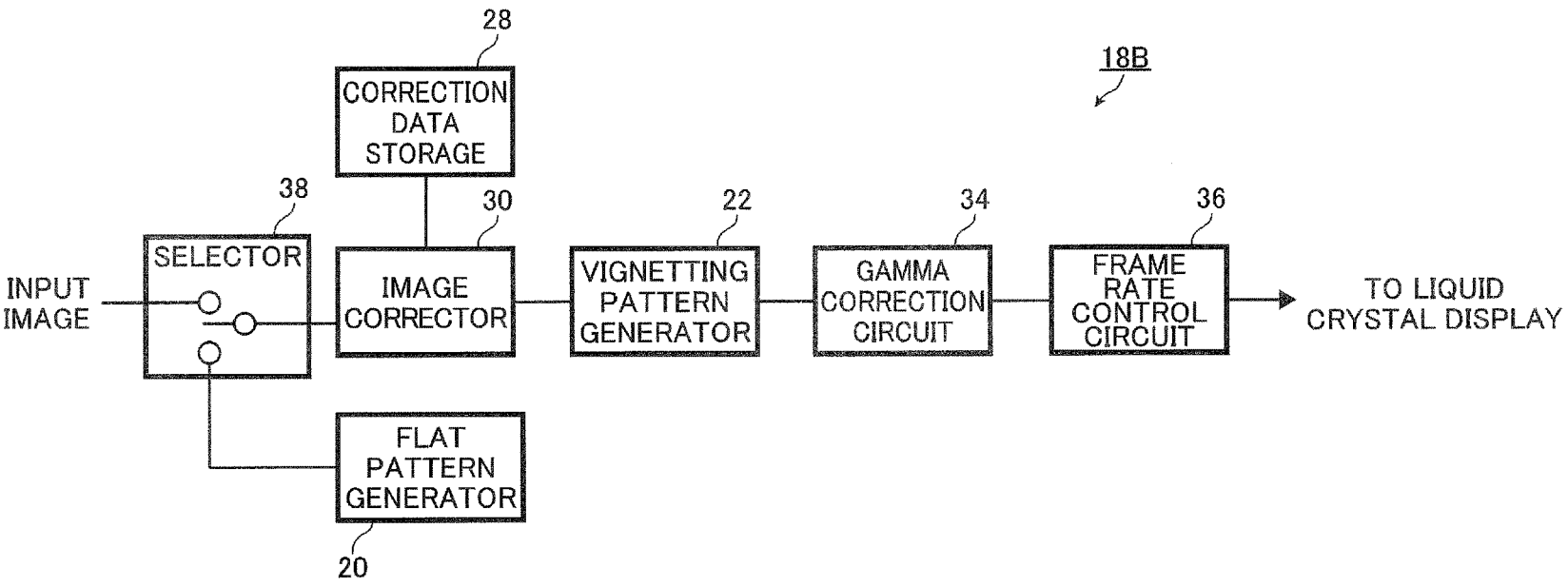
FIG. 7 is a block diagram showing a second configuration example of the image correction device.

In the image correction device 18B shown in FIG. 7, in the case where a pattern image is displayed on the liquid crystal display 12, correction data with which brightness unevenness is not corrected is stored in the correction data storage 28.

In the image correction device 18B, a flat pattern image is inputted to the image corrector 30 through control by the selector 38.

Accordingly, in the image corrector 30, the brightness unevenness of the flat pattern image is not corrected with the correction data with which brightness unevenness is not corrected as stored in the correction data storage 28. That is, the flat pattern image is outputted from the image corrector 30 without any modification.

Subsequently, the flat pattern image outputted from the image corrector 30 and a vignetting pattern image are combined to generate a pattern image, which is thereafter displayed on the liquid crystal display 12 in the same manner as above.

On the other hand, in the case where an input image is displayed on the liquid crystal display 12, correction data for correcting brightness unevenness of an input image is stored in the correction data storage 28.

In the image correction device 18B, an input image is inputted to the image corrector 30 through control by the selector 38.

Accordingly, the image corrector 30 corrects brightness unevenness of the input image using the correction data for correcting brightness unevenness of an input image as stored in the correction data storage 28.

The input image whose brightness unevenness has been corrected is outputted while bypassing the vignetting pattern generator 22, and displayed on the liquid crystal display 12 in the same manner as above.

Figure 8:
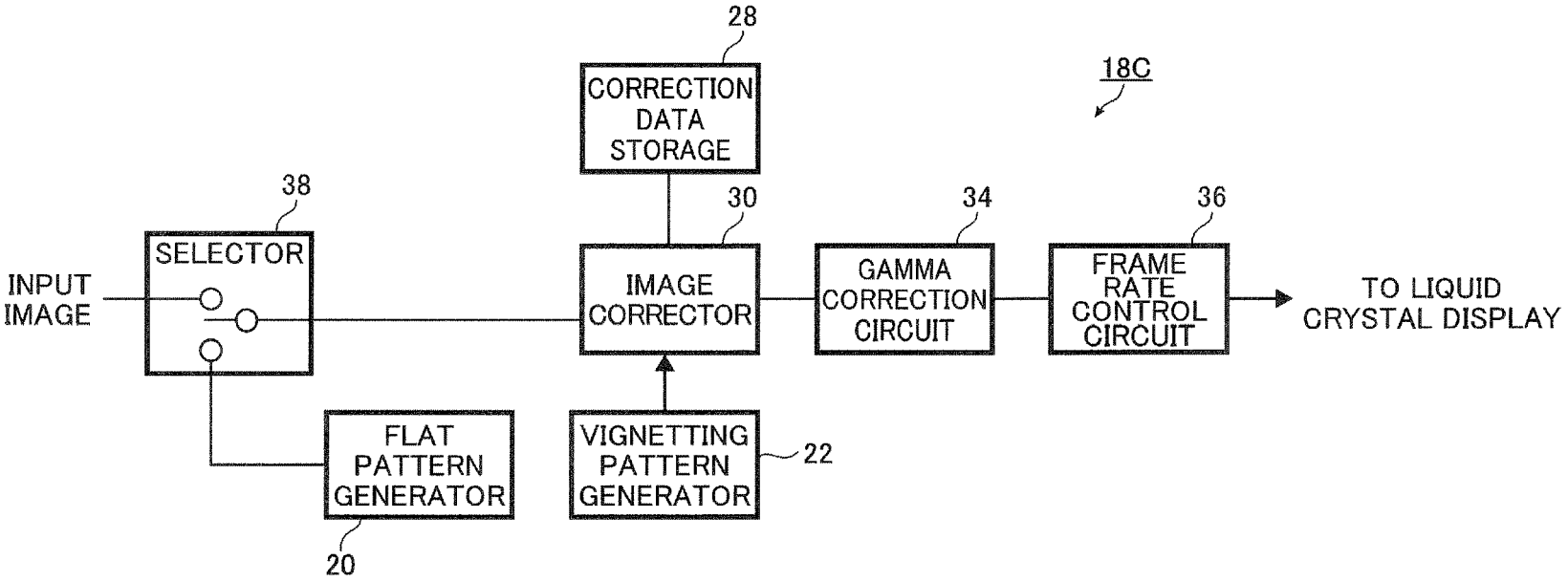
FIG. 8 is a block diagram showing a third configuration example of the image correction device.

In the image correction device 18C shown in FIG. 8, in the case where a vignetting pattern image is displayed on the liquid crystal display 12, image data of a vignetting pattern image is inputted to the image corrector 30. In addition, a flat pattern image is inputted to the image corrector 30 through control by the selector 38.

Accordingly, in the image correction device 18C, the flat pattern image and the vignetting pattern image are combined using the image data of the vignetting pattern image to generate a pattern image, which is thereafter displayed on the liquid crystal display 12 in the same manner as above.

The operation of displaying an image on the liquid crystal display 12 is the same as in the case of the image correction device 18A.

Figure 9:
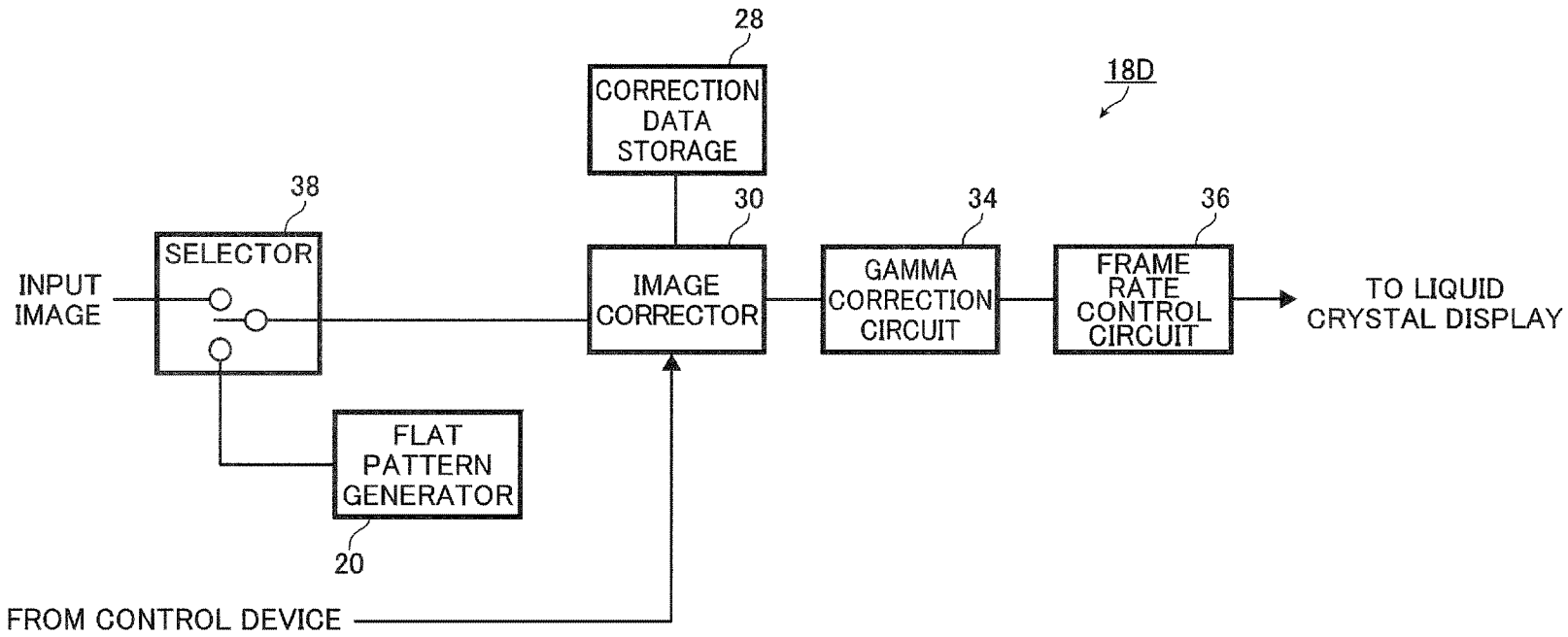
FIG. 9 is a block diagram showing a fourth configuration example of the image correction device.

In the image correction device 18D shown in FIG. 9, in the case where a vignetting pattern image is displayed on the liquid crystal display 12, image data of a vignetting pattern image inputted from outside the image correction device 18D, i.e., from the control device 16 is inputted to the image corrector 30. In addition, a flat pattern image is inputted to the image corrector 30 through control by the selector 38.

Subsequent operations are the same as in the case of the image correction device 18C.

The operation of displaying an image on the liquid crystal display 12 is the same as in the case of the image correction device 18A.

Figure 10:
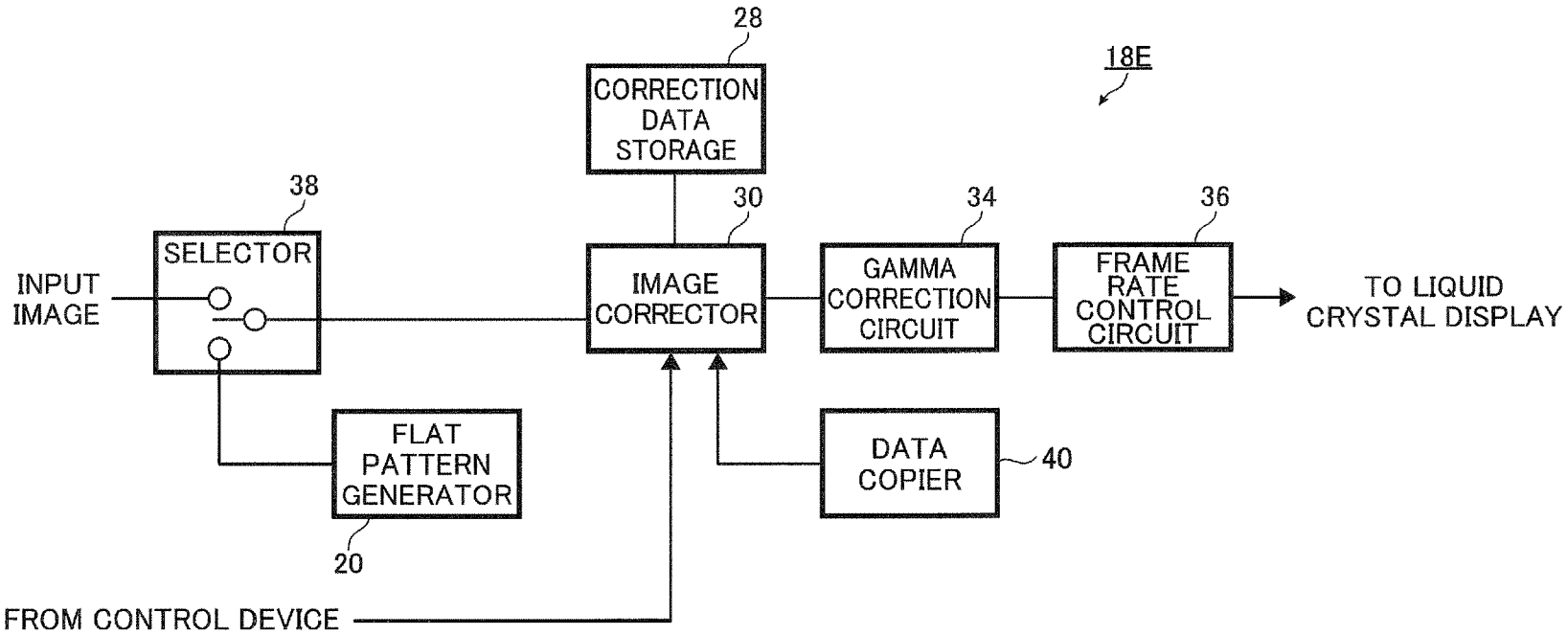
FIG. 10 is a block diagram showing a fifth configuration example of the image correction device.

In the image correction device 18E shown in FIG. 10, in the case where a pattern image is displayed on the liquid crystal display 12, a data copier 40 copies image data of a vignetting pattern image corresponding to pixels of one row or column as inputted from outside the image correction device 18E, i.e., from the control device 16 for each of the other rows or columns, and image data of the vignetting pattern image is inputted to the image corrector 30. In addition, a flat pattern image is inputted to the image corrector 30 through control by the selector 38.

Subsequent operations are the same as in the case of the image correction device 18C.

The operation of displaying an image on the liquid crystal display 12 is the same as in the case of the image correction device 18A.

In the case of the image correction devices 18A, 18B and 18C, the vignetting pattern generator 22 is disposed in the liquid crystal display 12 as a built-in element and therefore, this enables a vignetting pattern image to be generated in the interior of the image correction device 18 and it is not necessary to input image data of a vignetting pattern image from the control device 16 to the image correction device 18 as in the case of the image correction devices 18D and 18E. This is advantageous because correction data can be generated in a shorter time.

Similarly to the conventional example, the case where the image correction system 10 of this embodiment is used for a liquid crystal display having brightness characteristics in which the brightness value in the middle of a panel is low and gradually increases as approaching either of the right and left edges from the middle of the panel as shown in FIG. 3B, and a pattern image obtained by combining a gray flat pattern image composed of image data having a uniform grayscale level of 25 and corresponding to one screen and a vignetting pattern image composed of image data having inverted brightness characteristics obtained by inverting the brightness characteristics of the liquid crystal display 12 as shown in FIG. 4 is displayed on the liquid crystal display, is examined.

In this case, comparing to the conventional example, while the detection value in the middle of the panel of the liquid crystal display as obtained with the camera is 152 which is the same as in the conventional example, the detection values at the right and left edges as obtained with the camera are respectively 113 and 147 which are smaller than those in the conventional example because the brightness value gradually decreases as approaching either of the right and left edges from the middle. When target values after correction at the right and left edges to be used for mitigating brightness unevenness of the gray image displayed on the liquid crystal display are respectively 122 and 134 as with the conventional example, the amounts of correction are to be respectively −9 and 13. It can be seen that the amounts of correction are decreased to one seventh to one eighth of those in the conventional example.

Furthermore, in the case of the image correction system 10 of this embodiment, since the change in brightness on the whole screen is small when a pattern image is displayed on the liquid crystal display 12, this allows easier imaging of the image with the camera 14.

Furthermore, in the case of the image correction system 10 of this embodiment, since the amounts of correction are small, the generation of correction data can be finished earlier than the case of the conventional example. In the case of the conventional example for instance, an image needs to be repeatedly imaged two or three times to finish the generation of correction data. In contrast, in the case of the image correction system 10 of this embodiment, since the amounts of correction are small, imaging an image one time is enough to attain sufficient correction accuracy, so that the generation of correction data can be finished earlier. This results in a shorter takt time and improved production efficiency.

The specific configurations of the flat pattern generator 20, the vignetting pattern generator 22, the display controller 24, the correction data calculator 26, the correction data storage 28, the image corrector 30, the selector 38, the data copier 40 and the like are not limited and circuits having any configuration may be used as long as they can achieve equivalent functions.

The present invention is basically as described above.

While the present invention has been described in detail above, the invention is not limited to the above embodiment and various modifications and improvements may be made without departing from the spirit of the invention.

What is claimed is:

1. An image display device for causing an image used for generating correction data for correcting brightness unevenness of an input image inputted to a liquid crystal display to be displayed on the liquid crystal display, comprising:

a vignetting pattern generator circuit that generates a vignetting pattern image composed of image data having inverted brightness characteristics obtained by inverting brightness characteristics of a panel of the liquid crystal display; and a display controller circuit that controls to cause a pattern image obtained by combining a flat pattern image in gray composed of image data having a uniform grayscale level and the vignetting pattern image to be displayed on the liquid crystal display, wherein when brightness unevenness is present between a middle and each of right and left edges in the liquid crystal display, the vignetting pattern image has the inverted brightness characteristics obtained by vertically inverting brightness characteristics in a horizontal direction of a display screen of the liquid crystal display with the uniform grayscale level of the flat pattern image being taken as an axis of inversion, wherein when the brightness unevenness is present between the middle and each of upper and lower edges in the liquid crystal display, the vignetting pattern image has the inverted brightness characteristics obtained by horizontally inverting brightness characteristics in a vertical direction of the display screen of the liquid crystal display with the uniform grayscale level of the flat pattern image being taken as the axis of inversion, wherein in the vignetting pattern image, one piece of image data is set for each group of a certain number of pixels from among all pieces of image data corresponding to all pixels of the panel of the liquid crystal display and image data is calculated by interpolation between pieces of image data set for each group of the certain number of pixels, and wherein the vignetting pattern image has the inverted brightness characteristics which have been changed depending on at least one of a driving method, a model, a panel size and a production plant of the liquid crystal display.

2. An image correction device for correcting brightness unevenness of an input image inputted to a liquid crystal display, comprising:

the image display device according to claim 1;

a correction data storage circuit that stores correction data calculated by a correction data calculator circuit based on brightness values of image data of a captured image obtained by imaging the pattern image displayed on the liquid crystal display with a camera; and an image corrector circuit that corrects the brightness unevenness of the input image using the correction data stored in the correction data storage circuit.

3. The image correction device according to claim 2, wherein the vignetting pattern generator circuit generates vignetting pattern images corresponding to respective certain ranges of grayscale levels of image data of the input image, wherein the display controller circuit causes pattern images corresponding to the respective certain ranges of grayscale levels to be sequentially displayed on the liquid crystal display, wherein the correction data calculator circuit calculates pieces of correction data corresponding to the respective certain ranges of grayscale levels based on brightness values of pieces of image data of captured images obtained by sequentially imaging, by the camera, the pattern images corresponding to the respective certain ranges of grayscale levels and displayed on the liquid crystal display, wherein the correction data storage circuit stores the pieces of correction data corresponding to the respective certain ranges of grayscale levels as calculated by the correction data calculator circuit, and wherein the image corrector circuit corrects the brightness unevenness of the input image using the pieces of correction data corresponding to the grayscale levels of the image data of the input image and stored in the correction data storage circuit.

4. The image correction device according to claim 2, further comprising a flat pattern generator circuit that generates the flat pattern image.

5. The image correction device according to claim 2, further comprising:

a selector circuit that selects one of the input image and the pattern image and inputs a selected one to the image corrector circuit, wherein when the pattern image is displayed on the liquid crystal display, the correction data storage circuit stores correction data with which the brightness unevenness is not corrected;

the selector circuit inputs the pattern image to the image corrector circuit; and the display controller circuit carries out control to cause the pattern image whose brightness unevenness is not corrected by the image corrector circuit to be displayed on the liquid crystal display, and wherein when the input image is displayed on the liquid crystal display, the correction data storage circuit stores correction data for correcting the brightness unevenness of the input image to be displayed on the liquid crystal display;

the selector circuit inputs the input image to the image corrector circuit; and the display controller circuit carries out control to cause the input image whose brightness unevenness has been corrected by the image corrector circuit to be displayed on the liquid crystal display.

6. The image correction device according to claim 2, further comprising:

a selector circuit that selects one of the input image and the flat pattern image and inputs a selected one to the image corrector circuit, wherein when the pattern image is displayed on the liquid crystal display, the correction data storage circuit stores correction data with which the brightness unevenness is not corrected;

the selector circuit inputs the flat pattern image to the image corrector circuit; and the display controller circuit carries out control to cause a pattern image obtained by combining the flat pattern image whose brightness unevenness is not corrected by the image corrector circuit and the vignetting pattern image to be displayed on the liquid crystal display, and wherein when the input image is displayed on the liquid crystal display, the correction data storage circuit stores correction data for correcting the brightness unevenness of the input image;

the selector circuit inputs the input image to the image corrector; and the display controller circuit carries out control to cause the input image whose brightness unevenness has been corrected by the image corrector circuit to be displayed on the liquid crystal display.

7. The image correction device according to claim 2, further comprising:

a selector circuit that selects one of the input image and the flat pattern image and inputs a selected one to the image corrector circuit, wherein when the pattern image is displayed on the liquid crystal display, the image data of the vignetting pattern image is inputted to the image corrector circuit;

the selector inputs the flat pattern image to the image corrector circuit; and the display controller circuit carries out control to cause a pattern image obtained by combining, by means of the image corrector circuit, the flat pattern image and the vignetting pattern image using the image data of the vignetting pattern image having been inputted to the image corrector circuit to be displayed on the liquid crystal display, and wherein when the input image is displayed on the liquid crystal display, the correction data storage circuit stores correction data for correcting the brightness unevenness of the input image to be displayed on the liquid crystal display;

the selector circuit inputs the input image to the image corrector circuit; and the display controller circuit carries out control to cause the input image whose brightness unevenness has been corrected by the image corrector to be displayed on the liquid crystal display.

8. The image correction device according to claim 2, further comprising:

a selector circuit that selects one of the input image and the flat pattern image and inputs a selected one to the image corrector circuit, wherein when the pattern image is displayed on the liquid crystal display, the image data of the vignetting pattern image inputted from outside the image correction device is inputted to the image corrector circuit;

the selector circuit inputs the flat pattern image to the image corrector circuit; and the display controller circuit carries out control to cause a pattern image obtained by combining, by means of the image corrector circuit, the flat pattern image and the vignetting pattern image using the image data of the vignetting pattern image to be displayed on the liquid crystal display, and wherein when the input image is displayed on the liquid crystal display, the correction data storage circuit stores correction data for correcting the brightness unevenness of the input image to be displayed on the liquid crystal display;

the selector circuit inputs the input image to the image corrector circuit; and the display controller circuit carries out control to cause the input image whose brightness unevenness has been corrected by the image corrector circuit to be displayed on the liquid crystal display.

9. The image correction device according to claim 2, further comprising:

a selector circuit that selects one of the input image and the flat pattern image and inputs a selected one to the image corrector circuit, wherein when the pattern image is displayed on the liquid crystal display, a data copier copies image data of the vignetting pattern image corresponding to pixels of one row or column as inputted from outside the image correction device for each of other rows or columns to input the image data of the vignetting pattern image as a whole to the image corrector circuit;

the selector circuit inputs the flat pattern image to the image corrector circuit; and the display controller circuit carries out control to cause a pattern image obtained by combining, by means of the image corrector circuit, the flat pattern image and the vignetting pattern image using the image data of the vignetting pattern image having been inputted to the image corrector circuit to be displayed on the liquid crystal display, and wherein when the input image is displayed on the liquid crystal display, the correction data storage circuit stores correction data for correcting the brightness unevenness of the input image to be displayed on the liquid crystal display;

the selector circuit inputs the input image to the image corrector circuit; and the display controller circuit carries out control to cause the input image whose brightness unevenness has been corrected by the image corrector circuit to be displayed on the liquid crystal display.

10. An image correction system for generating correction data for correcting brightness unevenness of an input image inputted to a liquid crystal display, and correcting the brightness unevenness of the input image using the correction data, comprising:

the image correction device according to claim 2;

a camera which images the pattern image displayed on the liquid crystal display to generate image data of a captured image;

a correction data calculator circuit that calculates correction data for correcting the brightness unevenness of the input image based on brightness values of the image data of the captured image as generated by the camera; and a control circuit that controls an operation of the image correction device when the correction data is generated.

11. An image display device for causing an image used for generating correction data for correcting brightness unevenness of an input image inputted to a liquid crystal display to be displayed on the liquid crystal display, comprising:

a vignetting pattern generator circuit that generates a vignetting pattern image composed of image data having inverted brightness characteristics obtained by inverting brightness characteristics of a panel of the liquid crystal display; and a display controller circuit that controls to cause a pattern image obtained by combining a flat pattern image in gray composed of image data having a uniform grayscale level and the vignetting pattern image to be displayed on the liquid crystal display, wherein when brightness unevenness is present between a middle and each of right and left edges in the liquid crystal display, the vignetting pattern image has the inverted brightness characteristics obtained by vertically inverting brightness characteristics in a horizontal direction of a display screen of the liquid crystal display with the uniform grayscale level of the flat pattern image being taken as an axis of inversion, and wherein in the vignetting pattern image, image data corresponding to pixels of one row in the panel of the liquid crystal display is set for all rows in the panel of the liquid crystal display.

12. An image display device for causing an image used for generating correction data for correcting brightness unevenness of an input image inputted to a liquid crystal display to be displayed on the liquid crystal display, comprising:

a vignetting pattern generator circuit that generates a vignetting pattern image composed of image data having inverted brightness characteristics obtained by inverting brightness characteristics of a panel of the liquid crystal display; and a display controller circuit that controls to cause a pattern image obtained by combining a flat pattern image in gray composed of image data having a uniform grayscale level and the vignetting pattern image to be displayed on the liquid crystal display, wherein when brightness unevenness is present between a middle and each of upper and lower edges in the liquid crystal display, the vignetting pattern image has the inverted brightness characteristics obtained by horizontally inverting brightness characteristics in a vertical direction of a display screen of the liquid crystal display with the uniform grayscale level of the flat pattern image being taken as an axis of inversion, and wherein in the vignetting pattern image, image data corresponding to pixels of one column in the panel of the liquid crystal display is set for all columns in the panel of the liquid crystal display.

13. A correction data generation method for generating correction data for correcting brightness unevenness of an input image inputted to a liquid crystal display, comprising:

generating, with a flat pattern generator circuit, a flat pattern image in gray composed of image data having a uniform grayscale level;

generating, with a vignetting pattern generator circuit, a vignetting pattern image composed of image data having inverted brightness characteristics obtained by inverting brightness characteristics of a panel of the liquid crystal display;

carrying out, with a display controller circuit, control to cause a pattern image obtained by combining the flat pattern image and the vignetting pattern image to be displayed on the liquid crystal display;

imaging, with a camera, the pattern image displayed on the liquid crystal display to generate image data of a captured image; and calculating, with a correction data calculator circuit, the correction data for correcting the brightness unevenness of the input image based on brightness values of the image data of the captured image as generated by the camera, wherein when brightness unevenness is present between a middle and each of right and left edges in the liquid crystal display, the vignetting pattern image has the inverted brightness characteristics obtained by vertically inverting brightness characteristics in a horizontal direction of a display screen of the liquid crystal display with the uniform grayscale level of the flat pattern image being taken as an axis of inversion, wherein when the brightness unevenness is present between the middle and each of upper and lower edges in the liquid crystal display, the vignetting pattern image has the inverted brightness characteristics obtained by horizontally inverting brightness characteristics in a vertical direction of the display screen of the liquid crystal display with the uniform grayscale level of the flat pattern image being taken as the axis of inversion, and wherein in the vignetting pattern image, one piece of image data is set for each group of a certain number of pixels from among all pieces of image data corresponding to all pixels of the panel of the liquid crystal display and image data is calculated by interpolation between pieces of image data set for each group of the certain number of pixels.

14. An image correction method for correcting brightness unevenness of an input image inputted to a liquid crystal display, comprising:

generating, with a flat pattern generator circuit, a flat pattern image in gray composed of image data having a uniform grayscale level;

generating, with a vignetting pattern generator circuit, a vignetting pattern image composed of image data having inverted brightness characteristics obtained by inverting brightness characteristics of a panel of the liquid crystal display;

carrying out, with a display controller circuit, control to cause a pattern image obtained by combining the flat pattern image and the vignetting pattern image to be displayed on the liquid crystal display;

imaging, with a camera, the pattern image displayed on the liquid crystal display to generate image data of a captured image;

calculating, with a correction data calculator circuit, correction data for correcting the brightness unevenness of the input image based on brightness values of the image data of the captured image as generated by the camera;

storing, with a correction data storage circuit, the correction data calculated by the correction data calculator circuit; and correcting, with an image corrector circuit, the brightness unevenness of the input image using the correction data stored in the correction data storage circuit, wherein when brightness unevenness is present between a middle and each of right and left edges in the liquid crystal display, the vignetting pattern image has the inverted brightness characteristics obtained by vertically inverting brightness characteristics in a horizontal direction of a display screen of the liquid crystal display with the uniform grayscale level of the flat pattern image being taken as an axis of inversion, wherein when the brightness unevenness is present between the middle and each of upper and lower edges in the liquid crystal display, the vignetting pattern image has the inverted brightness characteristics obtained by horizontally inverting brightness characteristics in a vertical direction of the display screen of the liquid crystal display with the uniform grayscale level of the flat pattern image being taken as the axis of inversion, and wherein in the vignetting pattern image, one piece of image data is set for each group of a certain number of pixels from among all pieces of image data corresponding to all pixels of the panel of the liquid crystal display and image data is calculated by interpolation between pieces of image data set for each group of the certain number of pixels.

* * * * *